US005975210A

United States Patent [19]

Wilkins et al.

[11] Patent Number: 5,975,210

[45] Date of Patent: Nov. 2, 1999

[54] WELL COMPLETION SYSTEM HAVING A PRECISION CUT LOW PROFILE HELIX

[75] Inventors: Robert Lee Wilkins; Peter Moles, both of Houston, Tex.

[73] Assignee: Kvaerner Oilfield Products, Houston, Tex.

[21] Appl. No.: 09/001,498

[22] Filed: Dec. 31, 1997

[51] Int. Cl.[6] ..... E21B 43/01; E21B 23/00

[52] U.S. Cl. ..... 166/341; 166/382

[58] Field of Search ..... 166/382, 341, 166/368, 339, 338, 342, 349, 117.5

[56] References Cited

U.S. PATENT DOCUMENTS

| | | | |
|---|---|---|---|
| 3,739,846 | 6/1973 | Beson | 166/89 |
| 3,965,977 | 6/1976 | Beson | 166/88 |
| 4,154,298 | 5/1979 | Gano | 166/341 X |
| 4,427,072 | 1/1984 | Lawson | 166/345 |
| 4,625,804 | 12/1986 | Allen, Jr. | 166/341 X |
| 4,703,774 | 11/1987 | Seehausen | 137/614 |
| 4,709,725 | 12/1987 | Morrison | 137/614 |
| 4,717,287 | 1/1988 | Laursen | 166/341 X |
| 4,796,922 | 1/1989 | Prichard | 285/26 |
| 4,852,611 | 8/1989 | Knerr et al. | 137/595 |
| 5,372,199 | 12/1994 | Cegielski et al. | 166/368 |

FOREIGN PATENT DOCUMENTS

| | | |
|---|---|---|
| 2097885 | 5/1981 | United Kingdom . |
| 2132728 | 7/1984 | United Kingdom . |
| 2184508 | 12/1985 | United Kingdom . |
| 2195158 | 9/1986 | United Kingdom . |

*Primary Examiner*—Frank Tsay
*Attorney, Agent, or Firm*—Wendy K. Buskop; Bayko Gibson, et al.

[57] ABSTRACT

A well completion system for a side valve tree that has a precision cut low profile helix that can be used in completing a wellbore where the bore is substantially curved is provided. The well completion system has a typical spool body assembly having an inside surface defining a vertical bore extending therethrough and having at least a lateral production fluid outlet port. The spool body assembly has a helix is positioned at the lower end. The helix has a tubular member having a generally cylindrical outer surface defining an outer diameter and a generally cylindrical inner surface defining an inner diameter, an upper end and a lower end. The tubular member has an organ pipe-shaped cut in the upper end so that the upper end is generally elliptically shaped to form a pair of arcuate ramps which meet at an apex at the upper end and at a longitudinally extending slot near the lower end and a means for attaching the helix to the spool body assembly. An orientation key on the tubing hanger is precision machined to match the profile of the helix.

24 Claims, 9 Drawing Sheets

WELL COMPLETION SYSTEM HAVING A PRECISION CUT LOW PROFILE HELIX

BACKGROUND OF THE INVENTION

This invention relates to completing subsea wellheads.

Christmas trees having a horizontal production outlet offer several advantages for the production of oil and gas from subsea wellheads and have been in commercial use now for about 10 years. However, difficulties still arise from time to time in the use of such trees in orienting the tubing hanger so that the horizontal outlet in the tubing hanger is in alignment with the horizontal outlet though the body of the christmas tree. It will be appreciated that such problems typically arise far beneath the ocean's surface, where human intervention or even diagnosis is difficult.

Horizontal drilling techniques have advanced rapidly during the same period and have exacerbated the problem. Where the subsea well has a deviated wellbore, a great deal of force is required to twist the tubing hanger in the body of the christmas tree to bring the outlets into alignment, because the production tubing depending from the tubing hanger must undergo bending and twisting against the curvature of the wellbore and frictional contact between the production tubing and the casing tubing downhole in order for the tubing hanger to be rotated.

A mechanism commonly used to provide the required rotational force is a helix ramp situated near the bottom end of the christmas tree body and a key which is attached beneath the tubing hanger and follows the helix ramp as the tubing hanger is lowered into position in the christmas tree body. However, as discussed above, with the advent of directional drilling, the amount of rotational force and torque required to move the tubing downhole is greatly increased. A helix and key arrangement precision designed to better withstand this increased torque would be greatly appreciated.

OBJECTS OF THE INVENTION

It is an object of the present invention to provide a helix that can withstand greater amounts of friction and torque while orienting the tubing hanger to a predetermined position.

SUMMARY OF THE INVENTION

The present invention relates to a well completion system for a side valve tree that has a precision cut low profile helix that can be used in completing a wellbore where the bore is substantially curved. The well completion system has a typical spool body assembly having an inside surface defining a vertical bore extending therethrough and having at least a lateral production fluid outlet port. The spool body assembly preferably has a spool body that has an upper end and a lower end, where a helix is positioned at the lower end. The helix has a tubular member having a generally cylindrical outer surface defining an outer diameter and a generally cylindrical inner surface defining an inner diameter, an upper end and a lower end. The tubular member has an organ pipe-shaped cut in the upper end so that the upper end is generally elliptically shaped to form a pair of arcuate ramps which meet at an apex at the upper end and at a longitudinally extending slot near the lower end and a means for attaching the helix to the spool body assembly.

In another embodiment of the present invention, there is provided a tubing hanger defining a vertical production bore extending therethrough and having at least a lateral production fluid flow port. The tubing hanger has an upper end and a lower end and an orientation means extending from the lower end of the tubing hanger. The orientation means has an upper end, a lower end, a generally cylindrical inner surface and a generally cylindrical outer surface defining an outer diameter, wherein said orientation means defines a key near the lower end. The key is preferably machined so that it matches the profile of the helix.

wherein said key has a generally hexagonal cross-section in a plane normal to a radius drawn from the longitudinal axis of the orientation means, an upper apex and a lower apex with a first downwardly facing face and a second downwardly facing face, wherein said first downwardly facing face follows a first predetermined mathematical path and said second downwardly facing face follows a second predetermined mathematical path.

DETAILED DESCRIPTION OF THE PREFERRED EMBODIMENTS

Figure 1:
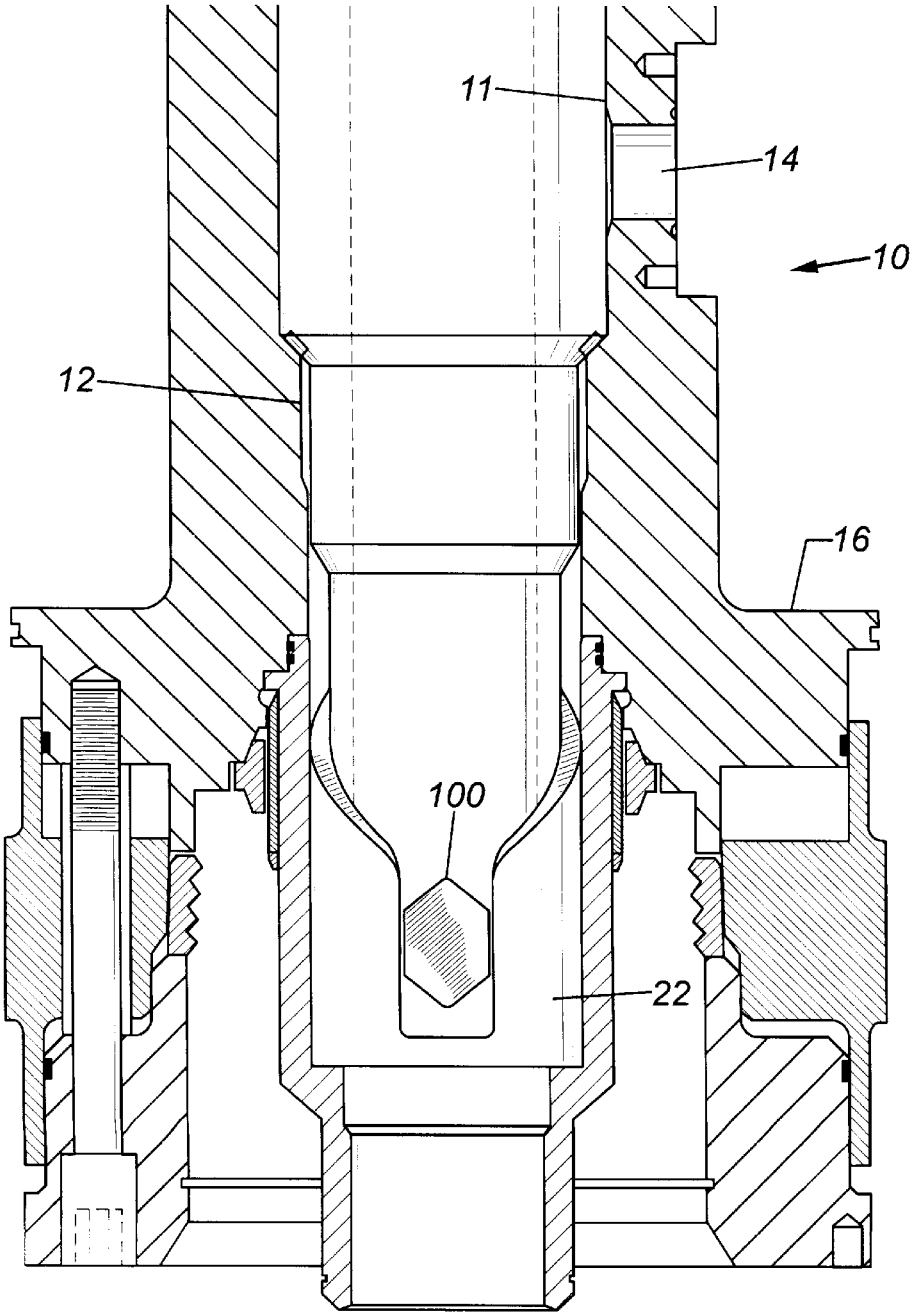
FIG. 1 is a perspective view of the present invention.
Figure 2:
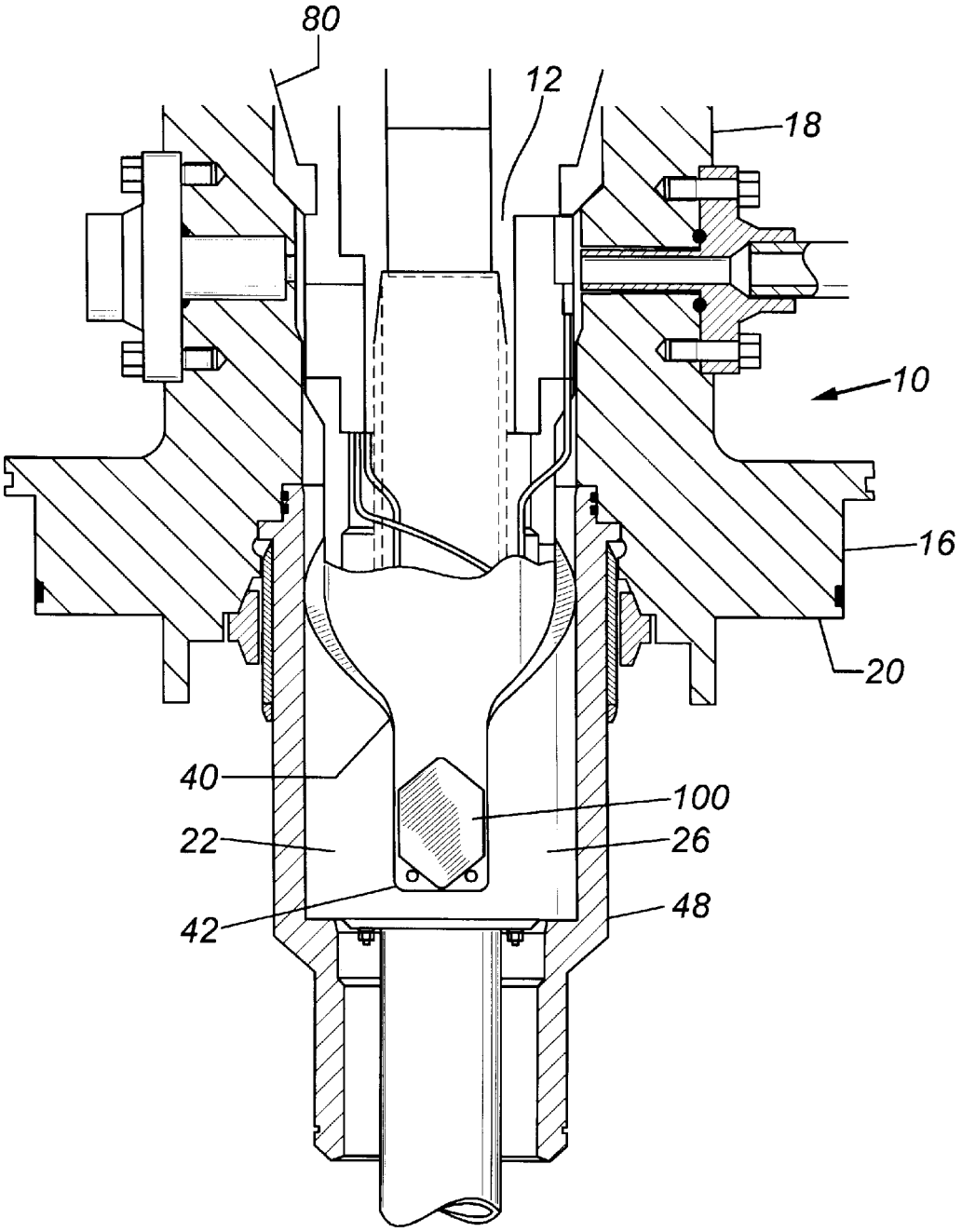
FIG. 2 is a cross-sectional view of the helix in the spool body.
Figure 3A:
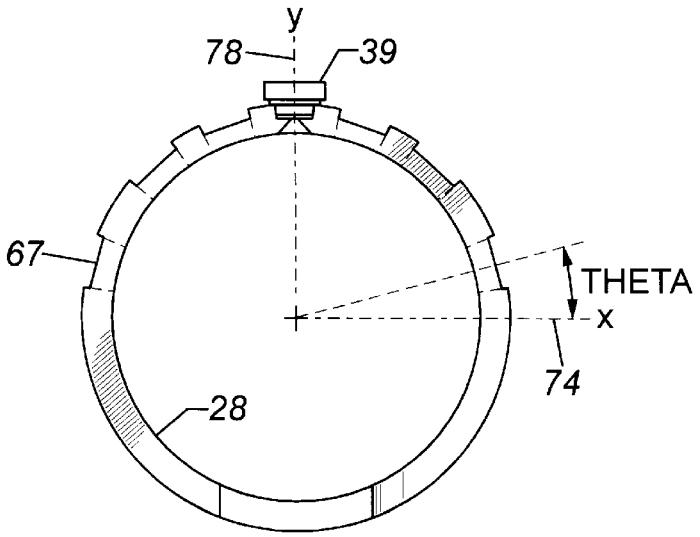
FIG. 3*a* is a sectional view of the helix.
Figure 3B:
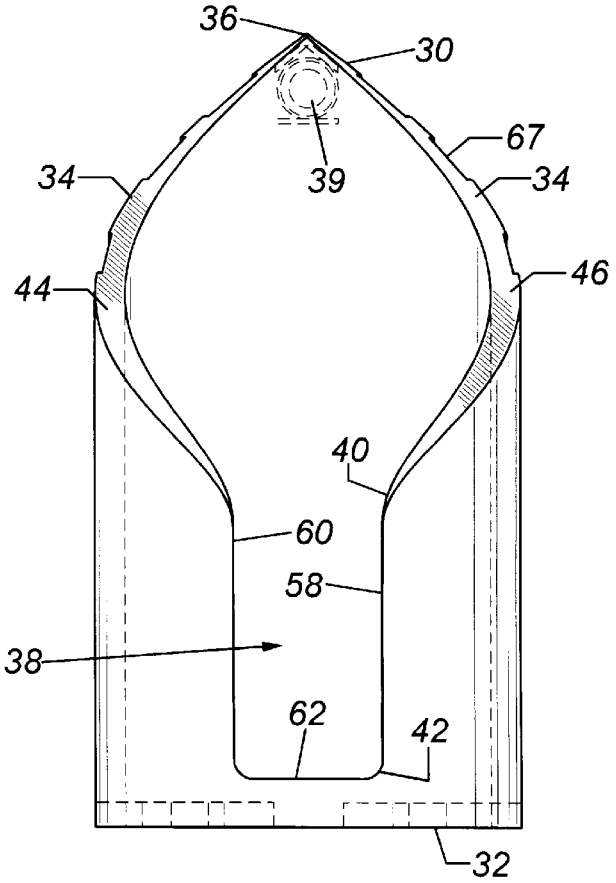
FIG. 3*b* is a perspective view of the helix.
Figure 3C:
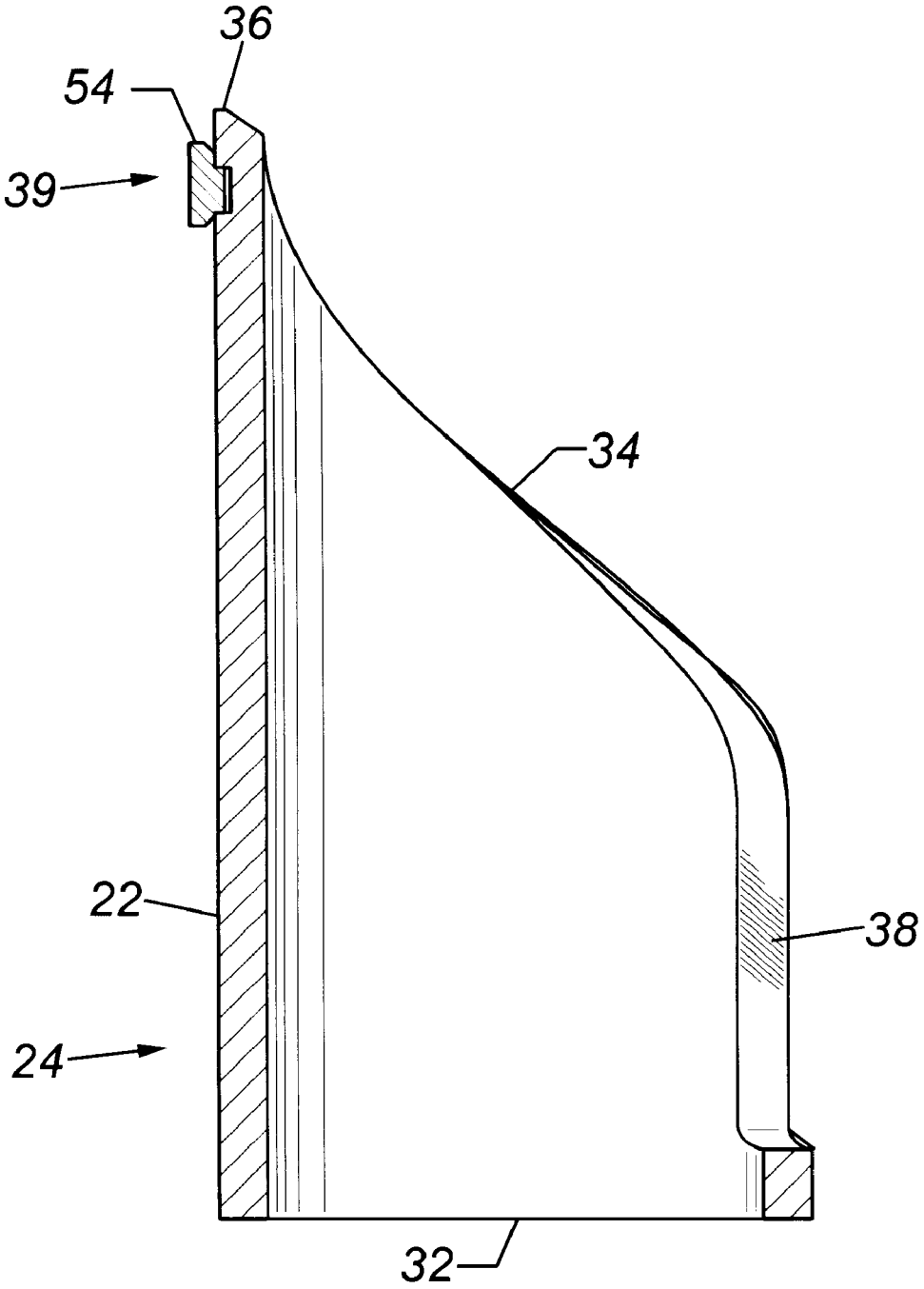
FIG. 3*c* is a side view of the helix.

The present invention relates to a well completion system for a side valve tree 8 that has a precision cut low profile helix that can be used in completing a wellbore where the bore is substantially curved. The well completion system has a typical spool body assembly 10 having an inside surface 11 defining a vertical bore 12 extending therethrough and having at least a lateral production fluid outlet port 14. (FIG. 1) The spool body assembly 10 preferably has a spool body 16 that has an upper end 18 and a lower end 20, where a helix 22 is positioned at the lower end 20. The helix 22 has a tubular member 24 having a generally cylindrical outer surface 26 defining an outer diameter and a generally cylindrical inner surface 28 defining an inner diameter, an upper end 30 and a lower end 32 (FIG. 2). The tubular member 24 has an organ pipe-shaped cut in the upper end 30 so that the upper end 30 is generally elliptically shaped to form a pair of arcuate ramps 34 which meet at an apex 36 at the upper end 30 and at a longitudinally extending slot 38 near the lower end 32 and a means 39 for attaching the helix 22 to the spool body assembly 10 (FIG. 3).

Preferably, the longitudinally extending slot 38 has an upper end 40 and a lower end 42 and the organ pipe-shaped cut forms a first surface portion 44 between the apex 36 of the organ pipe-shaped cut and the upper end 40 of the slot 38, and an opposite second surface portion 46 between the apex 36 of the organ pipe-shaped cut and the upper end of the slot 38. The first surface portion 44 and the second surface portion 46 are mirror images of one another. Preferably, the first surface portion 44 follows a first predetermined mathematical helical path and the second surface portion 46 follows a second predetermined mathematical helical path.

Figure 4:
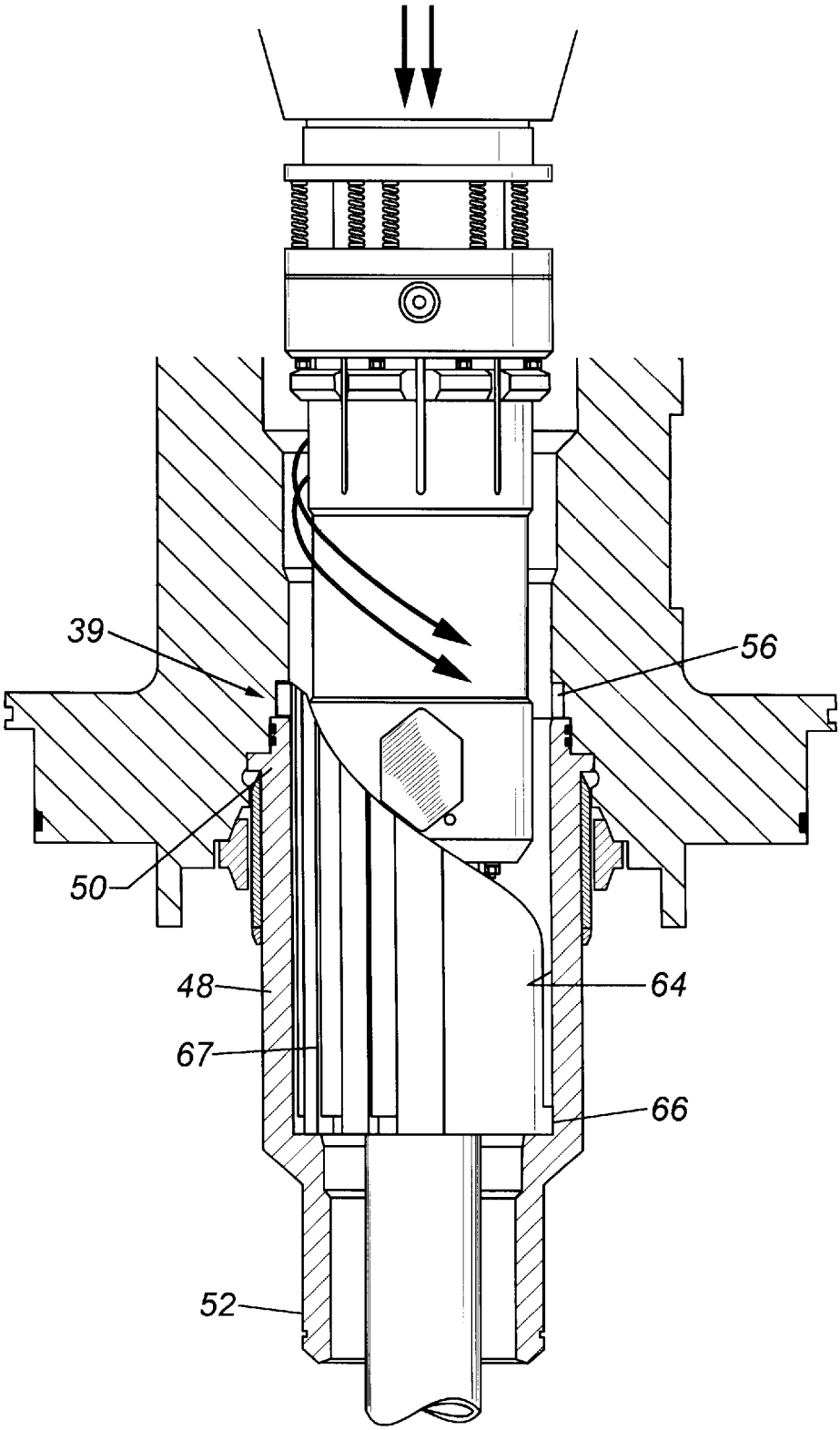
FIG. 4 is a perspective view of the tubing hanger in the helix.

The spool body 16 assembly preferably has a helix carrier sleeve 48 extending longitudinally from the lower end 30 of the spool body 16 (FIG. 4). The helix carrier sleeve 48 has an upper end 50 and a lower end 52. The means 39 for attaching the helix 22 to the spool body 16 can be a key means 54 attached to the outside surface of the helix 22 near the upper end. The key means 54 is closely received by a slot 56 formed by the inner surface of the spool body 16. The helix carrier sleeve 48 is raised up and into the spool body 16 from the lower end 30 of the spool body 16 so that the key is received by the slot 56 formed by the inner surface of the spool body 16.

The longitudinally extending slot 38 defined by the helix 22 preferably, has a first side wall 58 connected to a second side wall 60 by a bottom wall 62, the slot 38 can have a width of approximately 5 inches.

In a preferred embodiment, the helix carrier sleeve 48 has an inner surface 64 that defines an annular shoulder portion 66 between the upper end 50 and the lower end 52 of the helix carrier sleeve 48. The lower end 32 of the helix 22 is landed on the annular shoulder portion 66 of the helix carrier sleeve 48. The generally cylindrical outer surface 26 of the helix 22 defines a plurality of longitudinally extending channels 67 from the upper end 30 to the lower end 32 to form a flow path between the generally cylindrical outer surface 26 of the helix 22 and the inner surface 64 of the helix carrier sleeve 48. The purpose of the channels is to provide a flow path between the spool body and the helix so that the fluids do not pass through between the helix and tubing hanger.

The torque or bearing load placed on the helix as the tubing hanger is being lowered into the well increases as the tubing encounters resistance from a deviated wellbore. The channels 67 on the outer surface of the helix have a greater depth near the upper end than those near the lower end. The depth of the channels 67 decreases as they get closer to the lower end of the helix 22 to a point where there are no more channels 67 where the bearing load on the helix 22 is the highest.

Alignment of the tubing hanger is a critical element of a functional side valve tree. Aligning the tubing hanger is more difficult when the tubing extending from the tubing hanger encounters a bore that is curved. The curvature transmits a greater resistance on the tubing than if the bore where substantially straight. This resistance causes the lower end of the tubing hanger to hit against the inside wall of the spool body, making it difficult to align the tubing hanger. In order to alleviate some of this problem, the inside surface of the spool body 16 has a first centering boss 68 and a second centering boss 70 protruding therefrom for centralizing the tubing hanger within the spool body 16. (See FIGS. 5 and 6). The centralization of the tubing hanger is further aided by the apex of the helix. The apex of the helix is positioned in the same plane as the centering bosses and has an equal thickness to that of the centering bosses. This construction provides the centralization function so that when the lower end of the tubing hanger contacts the centering bosses or the apex of the helix, it is forced to align with the helix and ultimately be seated in the helix 22.

Preferably, the first centering boss 68 is positioned at an angle of about 120 degrees from the second centering boss 70, and at an angle of about 120 degrees from the apex of the helix 22 in a plane normal to the longitudinal axis of the spool body 16. The first centering boss 68 and the second centering boss 70 are positioned in the same plane as the key means 54 at the apex of the helix 22.

In a preferred embodiment, the inner diameter of the helix 22 has a radius and the first surface portion 44 has a pitch that is approximately 5 to 6 times the radius of the helix 22 and the second surface portion 46 has a pitch that is approximately 5 to 6 times the radius of the helix 22. In use, the first and second surface portions of the helix have an equal pitch. Preferably, the first surface portion 44 has a pitch that is approximately 5.524 times the radius of the helix 22 and the second surface portion 46 has a pitch that is approximately 5.524 times the radius of the helix 22.

In order to better define the helix, the helix 22 has a Y-axis 72 measured from the apex 36 in a plane normal to the longitudinal axis of the helix 22 and an X-axis 74 that is defined by the radius of the helix 22 and extending in a plane normal to the longitudinal axis of the helix 22 and orthogonal to the Y-axis and a Z-axis that corresponds with the longitudinal axis of the helix 22.

In a preferred embodiment, where the helix 22 has a circumference of approximately 44.5 inches and a height of approximately 26 inches from the lower end to the apex 36 of the helix 22, an inner diameter of approximately 12 inches and an outer diameter of approximately 14 inches. The following coordinates for the first surface portion 44 of a helix having the above dimensions have shown good results. Where an angle theta is measured from the apex 36 in a clockwise direction. $X_{id}$ is the inner diameter of the helix 22 and $X_{od}$ is the outer diameter of the helix 22 measured from the x-axis at theta. $Y_{id}$ is the inner diameter of the helix 22 and $Y_{od}$ is the outer diameter of the helix 22 measured from the y-axis at theta.

| THETA (deg) | $X_{id}$ | $X_{od}$ | $Y_{id}$ | $Y_{od}$ | Z |
|---|---|---|---|---|---|
| 0 | 0.0 | 0.0 | 6.063 | 7.085 | 0.00 |
| 15 | 1.569 | 1.834 | 5.856 | 6.844 | −1.396 |
| 30 | 3.031 | 3.543 | 5.250 | 6.136 | −2.792 |
| 45 | 4.287 | 5.010 | 4.287 | 5.010 | −4.188 |
| 60 | 5.250 | 6.136 | 3.031 | 3.543 | −5.583 |
| 75 | 5.856 | 6.844 | 1.569 | 1.834 | −6.979 |
| 90 | 6.063 | 7.085 | 0.0 | 0.0 | −8.375 |
| 105 | 5.856 | 6.844 | −1.569 | −1.834 | −9.771 |
| 120 | 5.250 | 6.136 | −3.031 | −3.543 | −11.167 |
| 135 | 4.287 | 5.010 | −4.287 | −5.010 | −12.563 |
| 150 | 3.031 | 3.543 | −5.250 | −6.136 | −13.958 |

Figure 5:
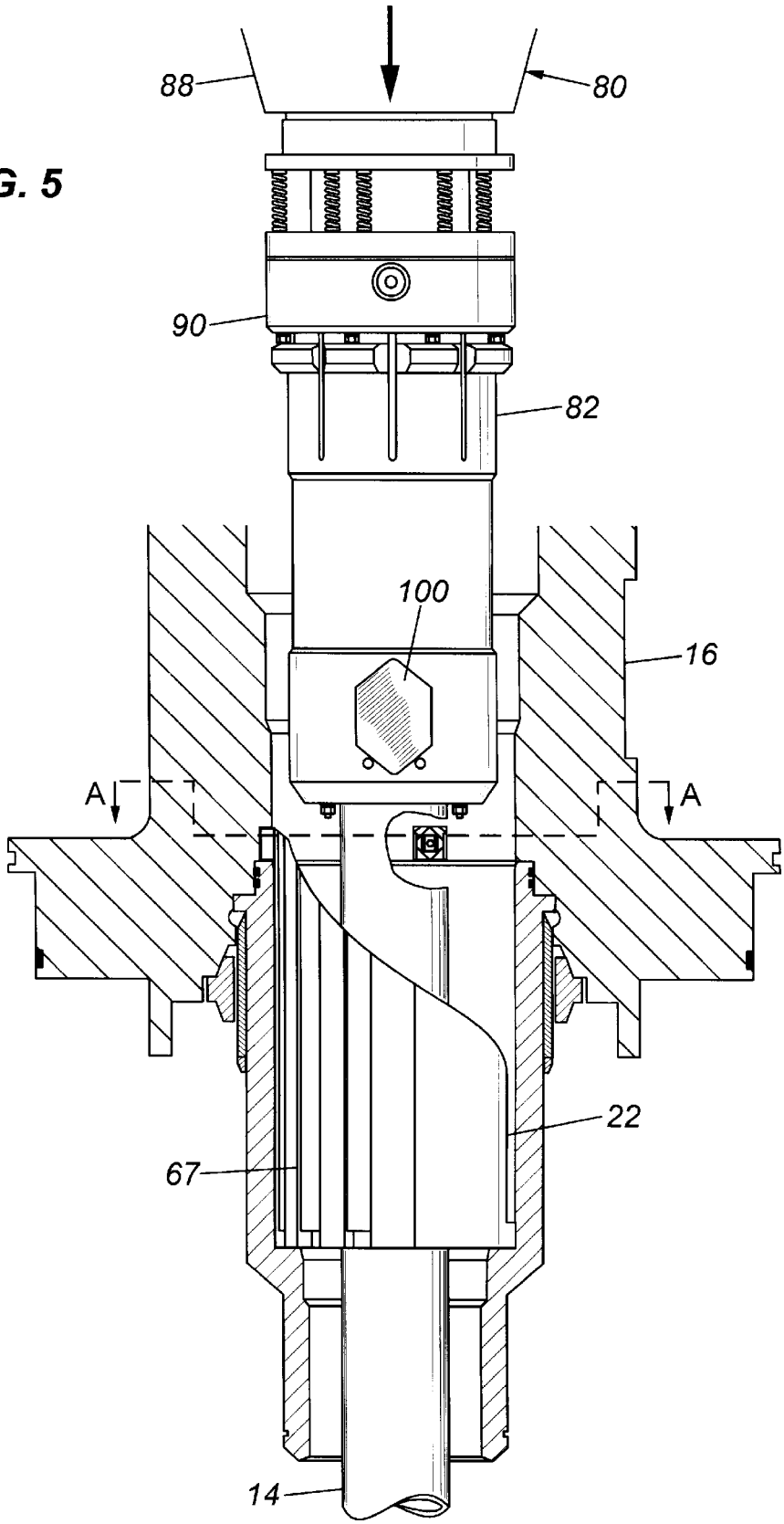
FIG. 5 is another perspective view of the tubing hanger in the helix.
Figure 6:
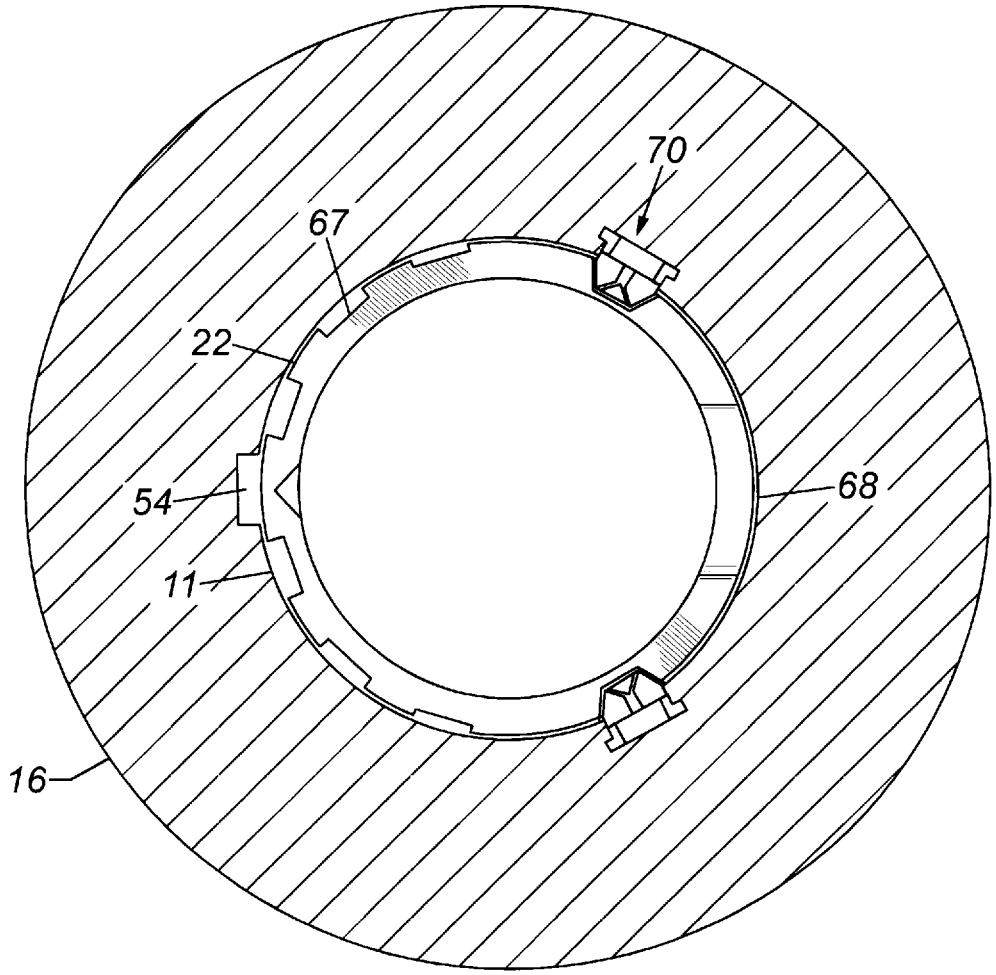
FIG. 6 is a view taken along cut lines A—A from FIG. 5.
Figure 7:
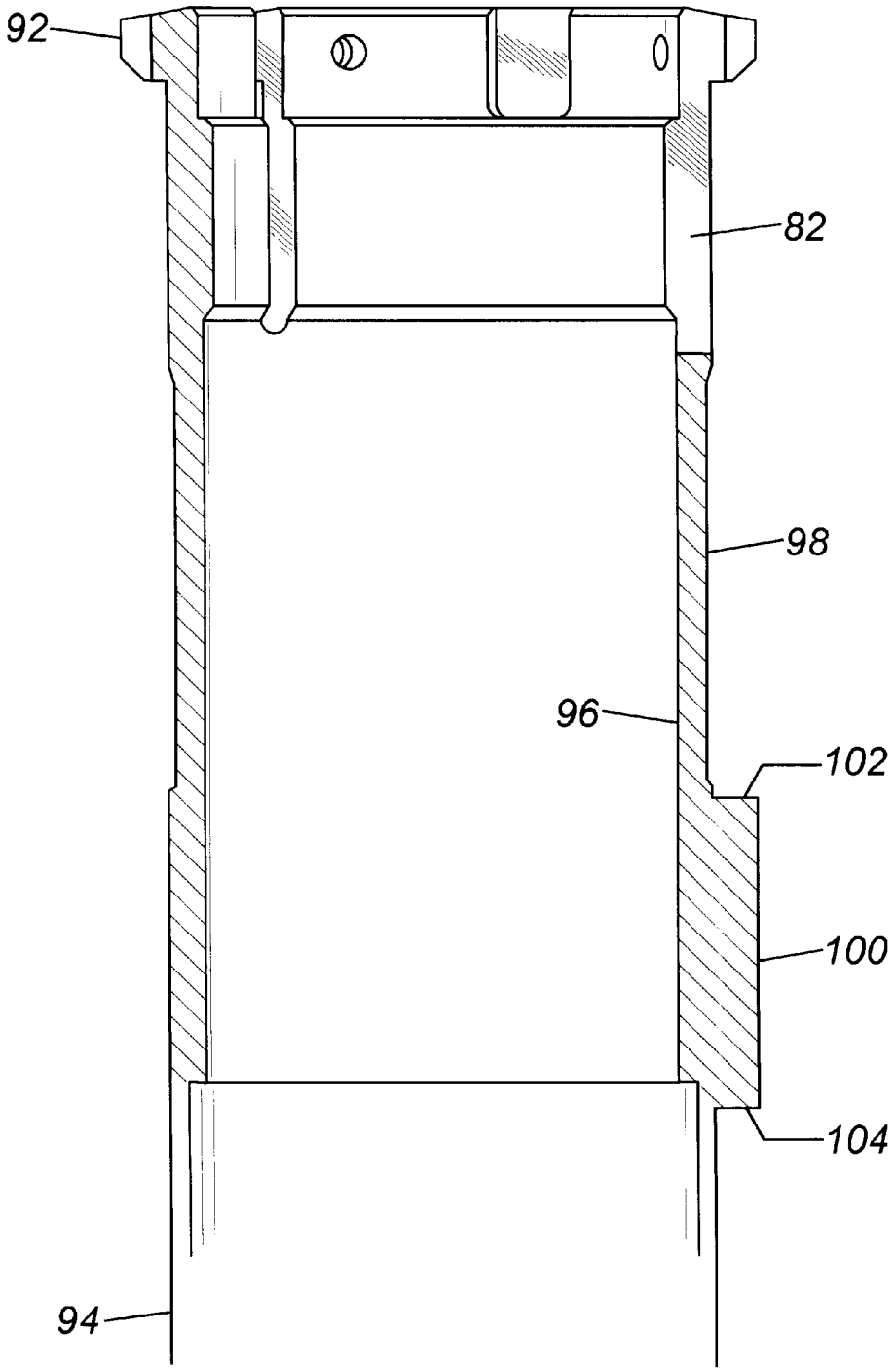
FIG. 7 is a side view of the orientation means.

In another embodiment of the present invention, there is provided a well completion system as described above with a tubing hanger 80 and an orientation means 82 as shown in FIGS. 5 and 7. The tubing hanger 80 defines a vertical production bore 84 extending therethrough and having at least a lateral production fluid flow port 86. (I need a drawing). The tubing hanger 80 has an upper end 88 and a lower end 90, with the orientation means 82 extending from the lower end 90 of the tubing hanger 80 (FIG. 5). Preferably, there is production tubing 114 disposed within and extending from the lower end 90 of the tubing hanger 80. The orientation means 82 has an upper end 92, a lower end 94, a generally cylindrical inner surface 96 and a generally cylindrical outer surface 98 defining an outer diameter. Preferably, the orientation means 82 is tubular. The orientation means 82 defines a key 100 near the lower end 94. The key 100 and the orientation means 82 can be of unitary construction.

Figure 8:
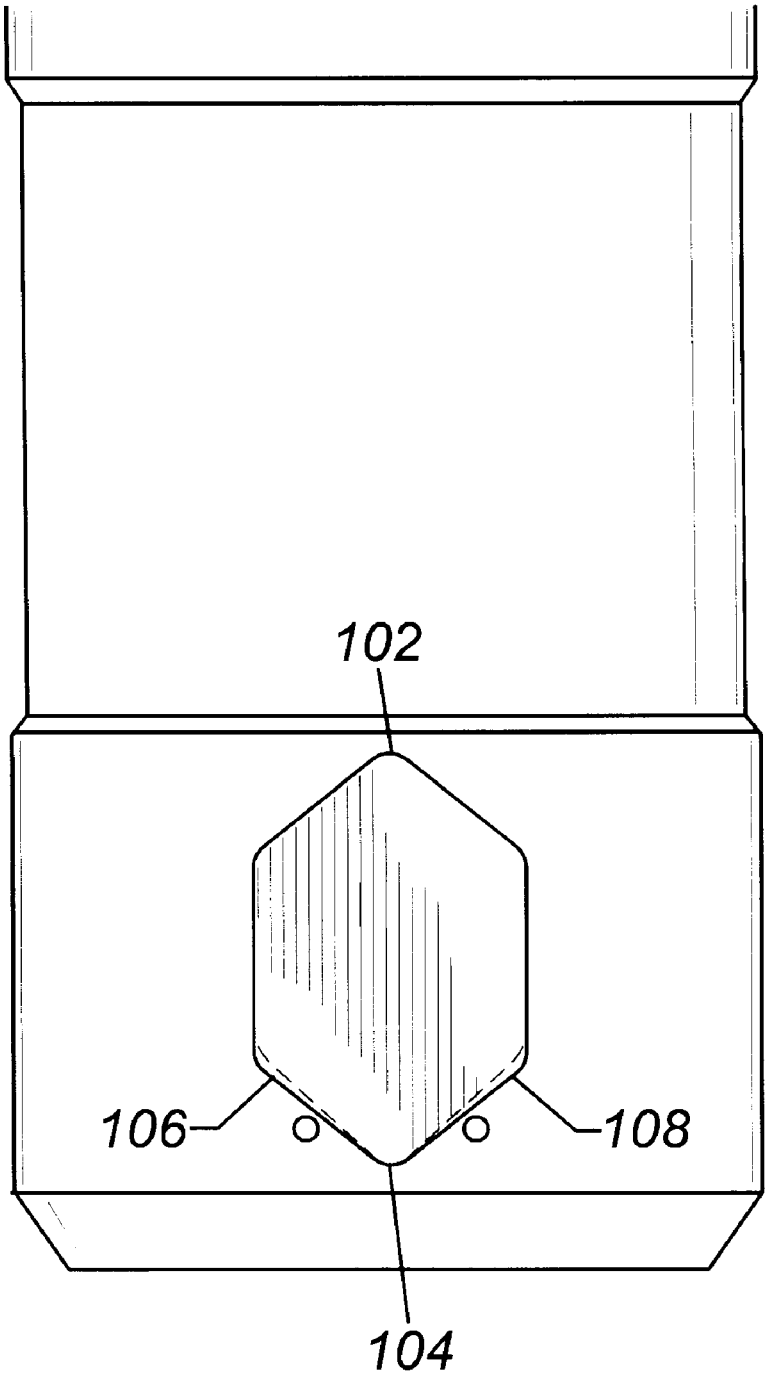
FIG. 8 is perspective view of the key.

The key 100 has a generally hexagonal cross-section in a plane normal to a radius drawn from the longitudinal axis of the orientation means 82, an upper apex 102 and a lower apex 104 with a first downwardly facing face 106 and a second downwardly facing face 108 FIG. 8). The first downwardly facing face 106 follows a first predetermined mathematical path that is slightly radiused with respect to an axis that is normal to the longitudinal axis of the orientation means 82. The second downwardly facing face 108 follows a second predetermined mathematical path that is slightly radiused with respect to an axis that is normal to the longitudinal axis of the orientation means 82. Preferably, the first and second predetermined mathematical paths are helical paths that have a pitch that matches the pitch on the first and second surface portions of the helix 22.

In a preferred embodiment, the first predetermined mathematical path has a right hand pitch of approximately 33.5 inches and the second predetermined mathematical path has a left hand pitch of approximately 33.5 inches. As mentioned above, the pitch of the key surfaces matches the pitch of the helix surfaces. This match is important for the helix in resisting the torque required to twist the tubing hanger into alignment.

It is preferred that the first downwardly facing face 106 of the key 100 form an angle of about 110 degrees with the second downwardly facing face 108. The width and depth of the key 100 are an important to withstand the torque placed on the tubing hanger so that the tubing hanger will align properly with the fluid outlet and the penetrators. The width of the key is very close to the width of the slot in the helix 22. The depth of the key is sufficient to withstand the pressure placed on it to overcome the friction from the tubing below and maintain the key on the proper path on the helix, so the key doesn't slide inside the helix or become damaged.

In use, the first downwardly facing face 106 and the second downwardly facing face 108 are defined by hard faced surfaces. The surfaces can be hard faced with stellite or another similar material to alleviate the possibility of damaging the surface of the key as the tubing hanger is lowered into the spool body. The stellite prevents galling between the key and the spool body and helix surfaces.

In yet another embodiment, there is provided a well completion system having a wellhead and spool body assembly landed on the well head. There is a tubing hanger 80, a helix 22, and an orientation means 80 defining a key 100 as described above. The tubing hanger defines a vertical production bore extending therethrough and the tubing hanger 80 is landed in the spool body 16.

The helix 22 comprises a tubular member 24 having a generally cylindrical outer surface 26 defining an outer diameter and a generally cylindrical inner surface 28 defining an inner diameter, an upper end 30 and a lower end 32. The longitudinally extending slot 38 has an upper end 40 and a lower end 42 and the organ pipe-shaped cut forms a first surface portion 44 between the apex 36 of the organ pipe-shaped cut and the upper end of the slot 38, and an opposite second surface portion 46 between the apex 36 of the organ pipe-shaped cut and the upper end of the slot 38. The first surface portion 44 and the second surface portion 46 are mirror images of one another. Preferably, the first surface portion 44 follows a first predetermined mathematical helical path and the second surface portion 46 follows a second predetermined mathematical helical path.

A means for attaching the helix 22 to the spool body 16 is attached to the outer surface of the helix 22.

There is an orientation means 82 attached to the lower end 90 of the tubing hanger 80, the orientation means 82 defines a key 100 that has a generally hexagonal cross-section in a plane normal to a radius drawn from the longitudinal axis of the orientation means 82, an upper apex 102 and a lower apex 104 with a first downwardly facing face 106 and a second downwardly facing face 108. The first downwardly facing face 106 and the second downwardly facing face 108 follow a predetermined mathematical path that is slightly radiused with respect to an axis that is normal to the longitudinal axis of the orientation means 82 as described above. Likewise, the first predetermined mathematical helical path followed by the first surface portion 44 is complementary to the first predetermined mathematical path followed by the first downwardly facing face 106 of the key 100 and the second predetermined mathematical helical path followed by the second surface portion 46 is complementary to the second predetermined mathematical path followed by the second downwardly facing face 108 of the key 100.

Preferably, the first predetermined mathematical path has a right hand pitch of approximately 33.5 inches; the second predetermined mathematical path has a left hand pitch of approximately 33.5 inches; the first surface portion 44 has a pitch of approximately 33.5 inches; and the second surface portion 46 has a pitch of approximately 33.5 inches.

In another embodiment of the present invention, there is provided a method for installing a tubing hanger 80 in a spool body 16 situated on a subsea wellhead positioned on a wellbore having a substantial curve so that a high degree of frictional resistance is created when production tubing is lowered downhole. The spool body 16 has an inside surface defining a vertical bore extending therethrough and the tubing hanger 80 defines a vertical production bore extending therethrough and having at least a lateral production fluid flow port. This type of method is useful because of the increase in the number of directional wells.

The method includes a helix 22 as described previously positioned within the spool body 16, so that the helix 22 is in a fixed position within the spool body 16. An orientation means 82 is attached to a lower end of the tubing hanger 80. The orientation means 82 defines a key 100 as described above with a first downwardly facing face 106 and a second downwardly facing face 108. Where the first downwardly facing face 106 and the second downwardly facing face 108 each follow a predetermined mathematical path that is slightly radiused with respect to an axis that is normal to the longitudinal axis of the orientation means 82.

Enough force must be placed on the tubing hanger 80 to overcome the high degree of frictional resistance on the tubing created by the substantial curve of the wellbore so that the tubing hanger can be rotated. The tubing hanger 80 is lowered into the spool body 16 vertical bore. The tubing hanger 80 is centralized inside the spool body 16 and the key is contacted with one of the arcuate ramps 34. The tubing hanger is continues to be lowered so that the key 100 follows the ramp and lands in the longitudinally extending slot 38. The step of centralizing preferably includes providing a pair of centering bosses on the inside surface of the spool body positioned in a common horizontal plane with the apex of the helix, lowering the tubing hanger, and aligning the tubing hanger with the inner diameter of the helix between the pair of centering bosses and the apex of the helix. Once the key is landed in the slot, the lateral production fluid flow port in the tubing hanger 80 is in flow communication with the lateral production fluid outlet port in the spool body 16 and the hydraulic and electric penetrators are aligned as well.

While certain preferred embodiments of the invention have been described herein, the invention is not to be construed as so limited, except to the extent that such limitations are found in the claims.

What is claimed is:

1. A well completion system comprising:

a spool body assembly having an inside surface defining a vertical bore extending therethrough, and having at least a lateral production fluid outlet port;

a helix comprising a tubular member having a generally cylindrical outer surface defining an outer diameter and a generally cylindrical inner surface defining an inner diameter, an upper end and a lower end, wherein said tubular member has an organ pipe-shaped cut in the upper end so that the upper end is generally elliptically shaped to form a pair of arcuate ramps which meet at an apex at the upper end and at a longitudinally extending slot near the lower end, and a means for attaching the helix to the spool body assembly;

wherein the longitudinally extending slot has an upper end and a lower end and said organ pipe-shaped cut forms a first surface portion between the apex of the organ pipe-shaped cut and the upper end of said slot, and an opposite second surface portion between the apex of the organ pipe-shaped cut and the upper end of said slot, said first surface portion and said second surface portion being mirror images of one another;

wherein the first surface portion follows a first predetermined mathematical helical path and the second surface portion follows a second predetermined mathematical helical path.

2. An apparatus as in claim 1, wherein the spool body assembly comprises a spool body having an upper end and a lower end and a helix carrier sleeve having an upper end and a lower end extending longitudinally from the lower end of the spool body, wherein said means for attaching the helix to the spool body assembly comprises a key means attached to the outside surface of the helix near the upper end, said key means being closely received by a depression formed by the inner surface of the spool body.

3. An apparatus as in claim 2, wherein the helix carrier sleeve has an inner surface that defines an annular shoulder portion between the upper end and the lower end of the helix carrier sleeve, wherein the lower end of the helix is landed on the annular shoulder portion of the helix carrier sleeve.

4. An apparatus as in claim 2, wherein said generally cylindrical outer surface of said helix defines a plurality of longitudinally extending channels from the upper end to the lower end to form a flow path between the outer surface of the helix and the inner surface of the helix carrier sleeve.

5. An apparatus as in claim 4, wherein the longitudinally extending channels positioned near the upper end of the helix have a greater depth than the longitudinally extending channels positoned near the lower end.

6. An apparatus as in claim 1, wherein said longitudinally extending slot defined by said helix has a first side wall connected to a second side wall by a bottom wall, said slot having a width of approximately 5 inches.

7. An apparatus as in claim 1, wherein the inside surface of the spool body assembly has a first centering boss and a second centering boss protruding therefrom for centering a tubing hanger assembly within the spool body.

8. An apparatus as in claim 7, wherein said first centering boss is positioned at an angle of about 120 degrees from said second centering boss in a plane normal to the longitudinal axis of the spool body, wherein said first centering boss and said second centering boss are positioned in about the same plane as the key means on the helix.

9. An apparatus as in claim 1, wherein the inner diameter of the helix has a radius and the first surface portion has a pitch that is approximately 5 to 6 times the radius of the helix and said second surface portion has a pitch that is approximately 5 to 6 times the radius of the helix.

10. An apparatus as in claim 9, wherein the first surface portion has a pitch that is approximately 5.5 times the radius of the helix and said second surface portion has a pitch that is approximately 5.5 times the radius of the helix.

11. An apparatus as in claim 1, wherein the helix has a Y-axis measured from the apex to the longitudinal axis in a plane normal to the longitudinal axis of the helix and an X-axis extending in such plane normal to the Y-axis, and a Z-axis that corresponds with the longitudinal axis of the helix.

12. An apparatus as in claim 11, wherein the first surface portion of the helix contains the points shown in the following table:

| THETA (deg) | $X_{id}$ | $X_{od}$ | $Y_{id}$ | $Y_{od}$ | Z |
|---|---|---|---|---|---|
| 0 | 0.0 | 0.0 | 6.063 | 7.085 | 0.00 |
| 15 | 1.569 | 1.834 | 5.856 | 6.844 | −1.396 |
| 30 | 3.031 | 3.543 | 5.250 | 6.136 | −2.792 |
| 45 | 4.287 | 5.010 | 4.287 | 5.010 | −4.188 |
| 60 | 5.250 | 6.136 | 3.031 | 3.543 | −5.583 |
| 75 | 5.856 | 6.844 | 1.569 | 1.834 | −6.979 |
| 90 | 6.063 | 7.085 | 0.0 | 0.0 | −8.375 |
| 105 | 5.856 | 6.844 | −1.569 | −1.834 | −9.771 |
| 120 | 5.250 | 6.136 | −3.031 | −3.543 | −11.167 |
| 135 | 4.287 | 5.010 | −4.287 | −5.010 | −12.563 |
| 150 | 3.031 | 3.543 | −5.250 | −6.136 | −13.958 |

wherein theta is measured from the apex in a clockwise direction, where $X_{id}$ is the x-ordinate of the inner diameter of the helix and $X_{od}$ is the x-ordinate of the outer diameter of the helix measured from the X-axis at theta, and $Y_{id}$ is the y-ordinate of the inner diameter of the helix and $Y_{od}$ is the y-ordinate of the outer diameter of the helix, and Z is the z-ordinate of the helix along the z-axis.

13. An apparatus comprising:

a tubing hanger defining a vertical production bore extending therethrough and having at least a lateral production fluid flow port, said tubing hanger having an upper end and a lower end;

an orientation means extending from the lower end of the tubing hanger, said orientation means having an upper end, a lower end, a generally cylindrical inner surface and a generally cylindrical outer surface defining an outer diameter, wherein said orientation means defines a key near the lower end;

wherein said key has a generally hexagonal cross-section in a plane normal to a radius drawn from the longitudinal axis of the orientation means, an upper apex and a lower apex with a first downwardly facing face and a second downwardly facing face, wherein said first downwardly facing face follows a first predetermined mathematical path and said second downwardly facing face follows a second predetermined mathematical path.

14. An apparatus as in claim 13, wherein the first predetermined mathematical path is a helical path.

15. An apparatus as in claim 13, wherein the orientation means comprises a tubular member.

16. An apparatus as in claim 13, wherein said first predetermined mathematical path has a right hand pitch of approximately 33.5 inches and said second predetermined mathematical path has a left hand pitch of approximately 33.5 inches.

17. An apparatus as in claim 13, wherein said first downwardly facing face forms an angle of about 110 degrees with the second downwardly facing face.

18. An apparatus as in claim 13, further comprising production tubing disposed within and extending from the lower end of the tubing hanger.

19. An apparatus as in claim 13, wherein said key and said orientation means are of unitary construction.

20. An apparatus as in claim 13, wherein said first downwardly facing face and said second downwardly facing face are defined by hard faced surfaces.

21. A well completion system comprising:

a wellhead;

a spool body having an inside surface defining a vertical bore extending therethrough, said spool body being landed on the wellhead;

a tubing hanger defining a vertical production bore extending therethrough, said tubing hanger having an upper end and a lower end, wherein said tubing hanger is landed in the spool body;

a helix comprising a tubular member having a generally cylindrical outer surface defining an outer diameter and a generally cylindrical inner surface defining an inner diameter, an upper end and a lower end, wherein said tubular member has an organ pipe-shaped cut that tapers to a longitudinally extending slot near the lower end, wherein the longitudinally extending slot has an upper end and a lower end and said organ pipe-shaped cut forms a first surface portion between the apex of the organ pipe-shaped cut and the upper end of said slot, and an opposite second surface portion between the apex of the organ pipe-shaped cut and the upper end of said slot, said first surface portion and said second surface portion being mirror images of one another;

means for attaching the helix to the spool body;

an orientation means attached to the lower end of the tubing hanger, said orientation means including a key that has a generally hexagonal cross-section in a plane normal to a radius drawn from the longitudinal axis of the orientation means, an upper apex and a lower apex with a first downwardly facing face and a second downwardly facing face, wherein said first downwardly facing face follows a first predetermined mathematical path and said second downwardly facing face follows a second predetermined mathematical path;

wherein the first surface portion follows a first predetermined mathematical helical path and the second surface portion follows a second predetermined mathematical helical path, wherein said first predetermined mathematical helical path is complementary to the first predetermined mathematical path followed by the first downwardly facing face of the key and the second predetermined mathematical helical path is complementary to the second predetermined mathematical path followed by the second downwardly facing face of the key.

22. An apparatus as in claim 21, wherein said first predetermined mathematical path has a right hand pitch of approximately 33.5 inches and said second predetermined mathematical path has a left hand pitch of approximately 33.5 inches and said first surface portion has a pitch of approximately 33.5 inches and said second surface portion has a pitch of approximately 33.5 inches.

23. A method for installing a tubing hanger having production tubing suspended therefrom in a spool body situated on a subsea wellhead positioned on a wellbore having a substantial curve so that a high degree of frictional resistance is created when the production tubing is lowered downhole, said spool body having an inside surface defining a vertical bore extending therethrough, said method comprising:

positioning a helix within the spool body, so that said helix is in a fixed position within the spool body, said helix comprising a tubular member having a generally cylindrical outer surface defining an outer diameter and a generally cylindrical inner surface defining an inner diameter, an upper end and a lower end, wherein said tubular member has an organ pipe-shaped cut in the upper end so that the upper end is generally elliptically shaped to form a pair of arcuate ramps which meet at an apex at the upper end and at a longitudinally extending slot near the lower end, wherein said arcuate ramps follow predetermined mathematical helical paths;

attaching an orientation means to a lower end of the tubing hanger, said orientation means defining a key that has an upper apex and a lower apex with a first downwardly facing face and a second downwardly facing face, wherein said first downwardly facing face and said second downwardly facing face each follow a predetermined mathematical path that is slightly radiused with respect to an axis that is normal to the longitudinal axis of the orientation means;

lowering said tubing hanger and the tubing into the spool body vertical bore;

placing force on the tubing hanger to overcome the high degree of frictional resistance on the tubing created by the substantial curve of the wellbore;

rotating the tubing hanger and aligning the tubing hanger with the horizontal centralizing the tubing hanger inside the spool body;

contacting the key with one of the arcuate ramps;

lowering the tubing hanger so that the key follows the ramp and lands in the longitudinally extending slot.

24. The method of claim 23, wherein the step of centralizing the tubing hanger consists of:

providing a pair of centering bosses on the inside surface of the spool body positioned in a common horizontal plane with the apex of the helix;

lowering the tubing hanger; and aligning the tubing hanger with the inner diameter of the helix between the pair of centering bosses and the apex of the helix.

* * * * *